United States Patent [19]

Shores

[11] 4,281,328

[45] Jul. 28, 1981

[54] SLIP RING ASSEMBLY

[75] Inventor: Marvin W. Shores, Pomona, Calif.

[73] Assignee: General Dynamics, Pomona Division, Pomona, Calif.

[21] Appl. No.: 116,340

[22] Filed: Jan. 28, 1980

[51] Int. Cl.[3] ..... H01Q 1/50

[52] U.S. Cl. ..... 343/763; 343/885; 339/5 M

[58] Field of Search ..... 343/757, 758, 762, 763, 343/766, 885; 310/231, 232; 339/5 P, 5 M

[56] References Cited

U.S. PATENT DOCUMENTS

| | | | |
|---|---|---|---|
| 3,191,177 | 6/1965 | Parzen | 343/757 |
| 3,604,009 | 9/1971 | Behnke | 343/757 |

*Primary Examiner*—Eli Lieberman

*Attorney, Agent, or Firm*—Neil F. Martin; Edward B. Johnson

[57] ABSTRACT

A flat slip ring which is larger in diameter than a conventional slip ring/brush assembly is attached to the rotatable unit concentric with and facing axially with respect to the shaft to carry the conventional slip ring/-brush assembly. A circular brush is mounted on the housing of the slip ring/brush assembly concentric with the shaft and facing the flat slip ring. An electrically conductive spring urges the circular brush into contact with the flat slip ring and provides a low impedance ground from the rotatable unit to the housing of the slip ring/brush assembly.

6 Claims, 6 Drawing Figures

SLIP RING ASSEMBLY

The Government has rights in this invention pursuant to Contract No. NO0024-79-C-5205 awarded by the U.S. Navy.

BACKGROUND OF THE INVENTION

This invention relates to slip ring assemblies which are used in connection with rotating systems such as radar antennas, missile launchers, gun mounts and the like. In such rotating systems, slip rings are used to make electrical contact between conductors on the rotating portion of the system and conductors on the stationary portion of the system. In the past, one of the slip rings has been used to ground the rotating portion of the system to the stationary portion of the system. In the case of ships, or other structures where the rotating portion of the system is exposed to the atmosphere, problems rise when lightning strikes the rotating portion of the system or when a large electro-magnetic pulse field is encountered due to a nuclear explosion. In these cases, a large surge of current flows through the grounding slip ring, is cross-coupled to the other electrical circuits on the slip ring assembly, and may cause catastrophic failure of sensitive components on the other circuits.

SUMMARY OF THE INVENTION

In accordance with this invention, ground currents from the rotating structure to the stationary supporting structure are routed through a flat slip ring which is concentric with the rotating structure and faces axially with respect to the rotating structure. The flat slip ring is larger in diameter than the other slip rings. A circular brush on the stationary structure contacts the flat slip ring and conducts the ground currents directly to the stationary structure. The other slip rings for the rotating structure all face axially with respect to the rotating structure and all lie within the flat slip ring and thus are not appreciably affected by the ground currents.

In an alternative embodiment, the brush incorporates a plurality of segments in a retainer. The retainer positions the segments loosely but allows movement toward and away from the slip ring.

It is therefore an object of this invention to provide a new and improved structure for conducting a large ground current to the stationary part of the system in such a way that the other electrical circuits on the slip ring assembly are not affected by the ground currents. Other objects and advantages of the invention will be apparent from the detailed description, together with the drawings in which like numerals refer to like parts throughout.

DESCRIPTION OF THE PREFERRED EMBODIMENT

Figure 1:
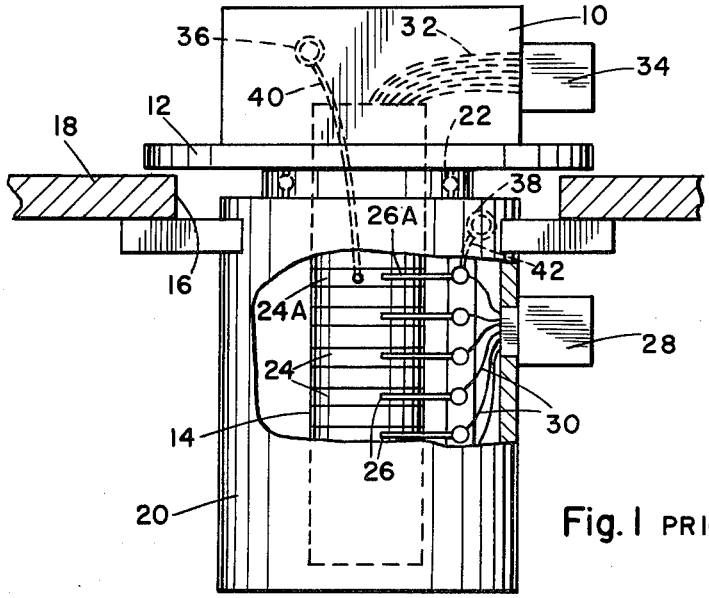
Fig. 1 PRIOR ART
FIG. 1 is a side elevational view of a prior art rotating structure and slip ring/brush assembly with a portion of the housing cut away to reveal inner detail.

FIG. 1 shows the prior art rotating structure 10 which may be a portion of a ship borne antenna mounting or a similar ship borne structure. The rotating structure 10 is rigidly attached to a cover plate 12 and has a hollow shaft 14 which extends downwardly through an opening 16 in a supporting plate 18. Hollow shaft 14 is enclosed by a slip ring/brush housing 20 which is journaled to shaft 14 by bearings 22.

The hollow shaft 14 has a plurality of slip rings 24 mounted thereon which interact with brushes 26 mounted on the housing 20. An electrical plug 28 is mounted on the side of the housing 20 and has a plurality of conductors 30 connect individual pins of the plug 28 to the individual brushes 26. A plurality of conductors 32 connect the individual slip rings 24 to the pins of a second electrical plug 34 mounted on the rotating structure 10. The electrical circuit between the plugs 28 and 30 are connected to other circuits (not shown) on the rotating structure 10 and the stationary structure 18 respectively. The other electrical circuits may be, for example, a radar transmitter on the stationary structure and a radar antenna on the rotating structure. In the prior art, one of the slip rings 24A and an associated brush 26A were connected respectively to ground lugs 36 and 38 by conductors 40 and 42 to ground the rotating structure 10 to the stationary structure 18. But in case of lightning striking the rotating structure 10, or exposure of the rotating structure 10 to a large electromagnetic pulse field generated by a nuclear explosion, a large pulse of current would flow through slip ring 24A and brush 26A and be cross-coupled by electro-magnetic induction to the other brushes 26 and the slip rings 24 and therefore to the circuits to which they are connected. This could cause catastrophic failure of sensitive components in the affected circuits.

Figure 2:
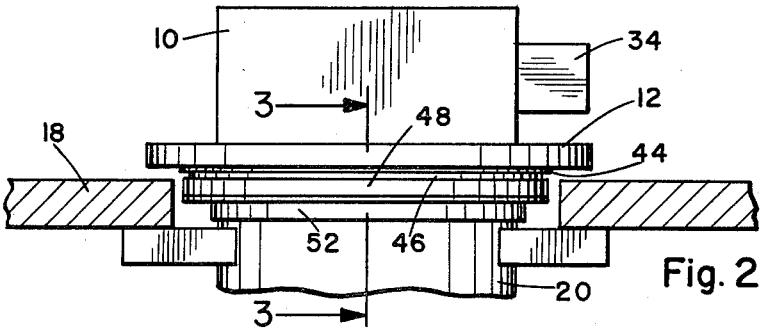
FIG. 2 is a side elevational view of the preferred embodiment of the invention installed on a rotating structure and slip ring/brush assembly similar to that shown in FIG. 1.
Figure 3:
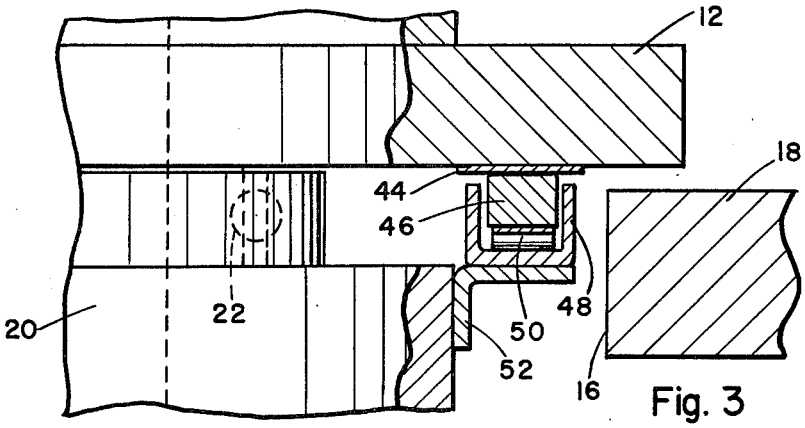
FIG. 3 is an enlarged cross-sectional view taken on line 3—3 of FIG. 2.
Figure 4:
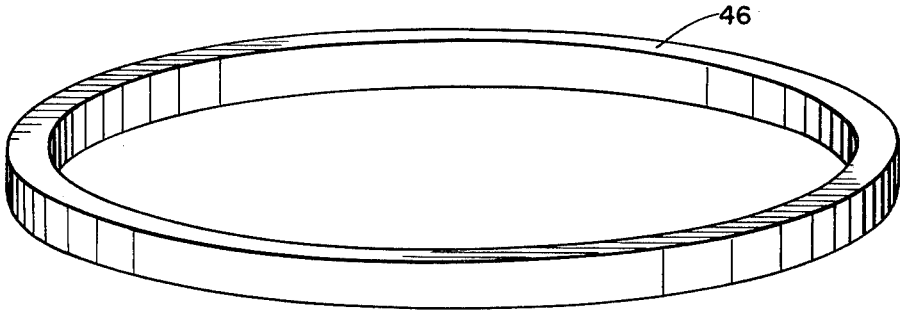
FIG. 4 is a perspective view of the continuous annular brush.

In the structure of the embodiment of the invention shown in FIGS. 2, 3 and 4, the ground currents are decoupled from the other circuits by means of a flat slip ring 44 and circular brush 46 which are larger in diameter than slip rings 24 and housing 20. Flat slip ring 44 is attached to cover plate 12 concentric with shaft 14 and facing axially with respect to shaft 14. Circular brush 46 is mounted concentric with slip ring 44 and faces slip ring 44. Circular brush 46 has approximately the same diameter as slip ring 44. Flat slip ring 44 is attached to cover plate 12, which is made of electrically conductive material, and circular brush 46 is contained in a U-shaped circular channel 48 and is urged into electrical contact with the slip ring 44 by a corrugated circular spring 50 in the bottom of channel 48. The U-shaped circular channel 48 is supported on the housing 20 by a right-angle flange 52. Circular brush 46, U-shaped circular channel 48, circular spring 50 and flange 52 are all made of electrically conductive material and provide a low impedance ground path from slip ring 44 to housing 20. In the case of a lightning strike or nuclear explosion, the high level ground currents are confined to the housing 20 and have minimal coupling to the other electrical circuits therewithin. The circular brush 46 also provides an electro-magnetic shield that shields the apertures of bearing 22 from outside electro-magnetic fields.

Figure 5:
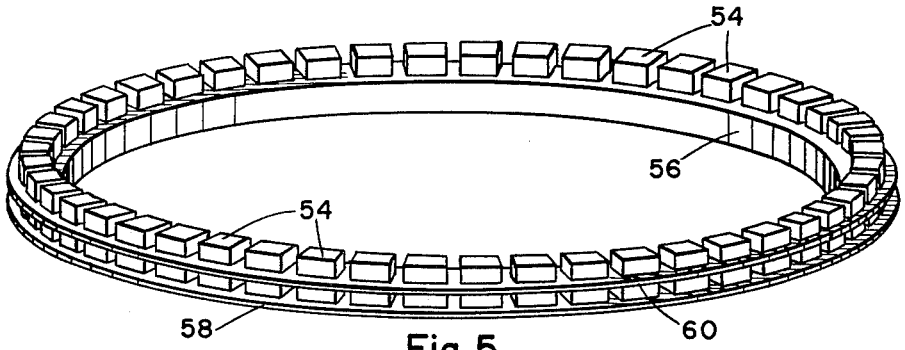
FIG. 5 is a perspective view of an alternative brush incorporating a plurality of segments.
Figure 6:
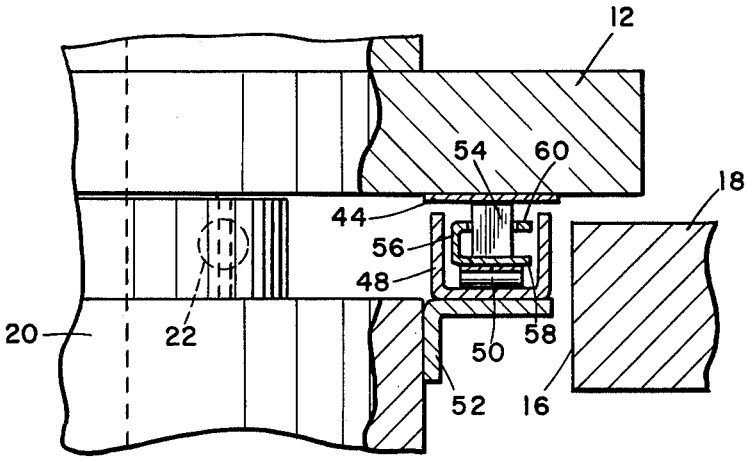
FIG. 6 is a view similar to FIG. 3, showing the installation of the alternative brush.

Referring now to FIGS. 5 and 6, an alternative embodiment of the circular brush is illustrated. A plurality of conductive brush segments 54 are positioned by retainer 56. The retainer has a generally U-shaped cross-section with a closed lower surface 58. The brush segments are received through openings in the upper surface 60. The spring 50 bears against the lower surface 58 and forces the retainer 56 toward the slip ring 44 resulting in good electrical contact between segments 54 and slip ring 44.

Having described my invention, I now claim:

1. In a rotary system having a supporting structure, a rotatable unit having a shaft, and a slip ring/brush assembly attached between said shaft and said supporting structure, the improvement comprising:

a flat slip ring of electrically conductive material on said rotatable unit concentric with said shaft and facing axially with respect to said shaft, and said flat slip ring being larger in diameter than said slip ring/brush assembly;

a circular brush mounted on said supporting structure concentric with said flat slip ring and facing said slip ring, said circular brush being approximately the same diameter as said flat slip ring;

means urging said circular brush into electrical contact with said flat ring;

means electrically connecting said flat slip ring to said rotatable structure; and whereby large pulses of electrical energy applied to said rotating structure are conducted to said supporting structure through said flat slip ring and circular brush without passing in close proximity to the electrical circuits passing through said slip ring/brush assembly.

2. The improvement defined in claim 1 further including:

a U-shaped circular channel for supporting said circular brush, said means urging said circular brush into contact with said flat slip ring being a circular corrugated spring in the bottom of said U-shaped circular channel.

3. The improvement defined in claim 1 wherein:

said flat slip ring is secured to and in electrical contact with said rotatable unit.

4. The improvement defined in claim 3 wherein:

said U-shaped circular channel and corrugated circular spring are made of electrically conductive material.

5. The improvement defined in claim 1 wherein:

said circular brush comprises a continuous annular ring.

6. The improvement defined in claim 1, wherein:

said circular brush comprises a plurality of segments spaced by a retainer.

* * * * *